US005174486A

United States Patent [19]

Latal et al.

[11] Patent Number: 5,174,486

[45] Date of Patent: Dec. 29, 1992

[54] SPRING GRIP ASSEMBLY GUN

[75] Inventors: James F. Latal, Elk Grove Village, Ill.; Jonathan D. Aos, Holmes City, Minn.

[73] Assignee: Illinois Tool Works Inc., Glenview, Ill.

[21] Appl. No.: 525,851

[22] Filed: May 21, 1990

[51] Int. Cl.[5] ..... B25C 5/00

[52] U.S. Cl. ..... 227/120; 227/130; 227/134

[58] Field of Search ..... 227/120, 130, 134, 127, 227/116, 129, 15, 18

[56] References Cited

U.S. PATENT DOCUMENTS

| | | | |
|---|---|---|---|
| 2,055,249 | 9/1936 | Cavanagh | 227/120 |
| 2,285,384 | 6/1942 | Schott | 227/142 |
| 2,959,155 | 11/1960 | Powers et al. | 227/130 |
| 4,183,453 | 1/1980 | Barrett et al. | 227/120 |
| 4,596,349 | 6/1986 | Herten | 227/18 |
| 4,610,381 | 9/1986 | Kramer et al. | 227/120 |

*Primary Examiner*—Frank T. Yost
*Assistant Examiner*—Allan M. Schrock
*Attorney, Agent, or Firm*—Schwartz & Weinrieb

[57] ABSTRACT

A fluid-driven tool for mechanically driving a spring-grip fastener onto a shaft or rod, which fasteners are automatically insertable within the tool and may be positioned at a predetermined depth upon the shaft by means of a stroke-adjusting device.

21 Claims, 2 Drawing Sheets

SPRING GRIP ASSEMBLY GUN

FIELD OF THE INVENTION

The present invention relates to a fastener applicator tool. More particularly, the invention provides a fluid-driven, gun-type tool for the rapid installation of a spring-grip fastener, which tool has a magazine for the continuous feeding of fasteners for mounting upon a shaft or rod.

BACKGROUND OF THE INVENTION

Spring-grip fasteners are utilized for the rapid mounting upon rods or shafts so as to secure components during high-production operations, such as, for example, the assembly of automobiles and appliances. The use of spring-grip fasteners expedites assembly by securing a member upon a shaft with minimal operator effort at great speed, which enhances economy and productivity.

Varying styles and shapes of spring-grip fasteners are available, and the same include round, rectangular or other geometric shapes. However, the more familiar fasteners comprise are an annulus with a plurality of tangs or flanges projecting toward the annulus center, which flanges are displaced from the plane of their perimeter or border. The fasteners are usually of a spring-type material, which allows deflection of the tangs during mounting upon a shaft and subsequent tendency toward recovery toward the reference position so as to secure the fasteners to the rods. Recovery toward the reference position inhibits fastener removal from the shaft or rod upon which it is mounted due to the fact that the gap or space defined between the tangs tends to be reduced to a value is smaller than the rod diameter as a result of the frictional engagement defined between the rod and the tangs as the rod is attempted to be moved in a withdrawal direction relative to the fastener.

Spring-grip fasteners are usually individually applied by means of a manually-driven tool, which inhibits rapid mounting of multiple grips upon the plurality of shafts, studs or other connectors in large assemblies. The manual-mount limitation to the speed or placement of a spring grip at more than one position inhibits rapid assembly and can lead to variable mounting depths, variable securing pressures characteristic of the spring grip placement, and consequently variation in relative securement of the parts.

SUMMARY OF THE INVENTION

The present invention provides an easily-handled, gun-like apparatus or tool for the rapid installation of spring-grip fasteners, which tool utilizes a fluid-driven piston to position the spring grip upon the rod or shaft. The pressure of the driving fluid may be varied so as to provide a mounting force which can be calibrated to the size of the grip fastener or to accommodate other variations required for the applied force. A stroke-adjusting device upon the second or back end of the gun limits the stroke of the fastener-applicator so as to mount the spring-grip fastener at a predetermined distance from the rod end. A magazine with a string or plurality of fasteners biased so as to continuously position a fastener within the applicator ram casing is affixed to the tool barrel. Thus, a plurality of spring-grip fasteners are mountable upon a rod or shaft at a predetermined distance from the shaft end without individually reloading the gun, and they are mountable so as to retain fasteners upon the shaft up to a predetermined force load.

BRIEF DESCRIPTION OF THE DRAWINGS

Various other objects, features, and attendant advantages of the present invention will become better understood from the following detailed description, when considered in connection with the accompanying drawings, in which like reference numerals identify like components throughout the several views, and in the drawings

DETAILED DESCRIPTION OF THE PREFERRED EMBODIMENT

Figures 1, 2:
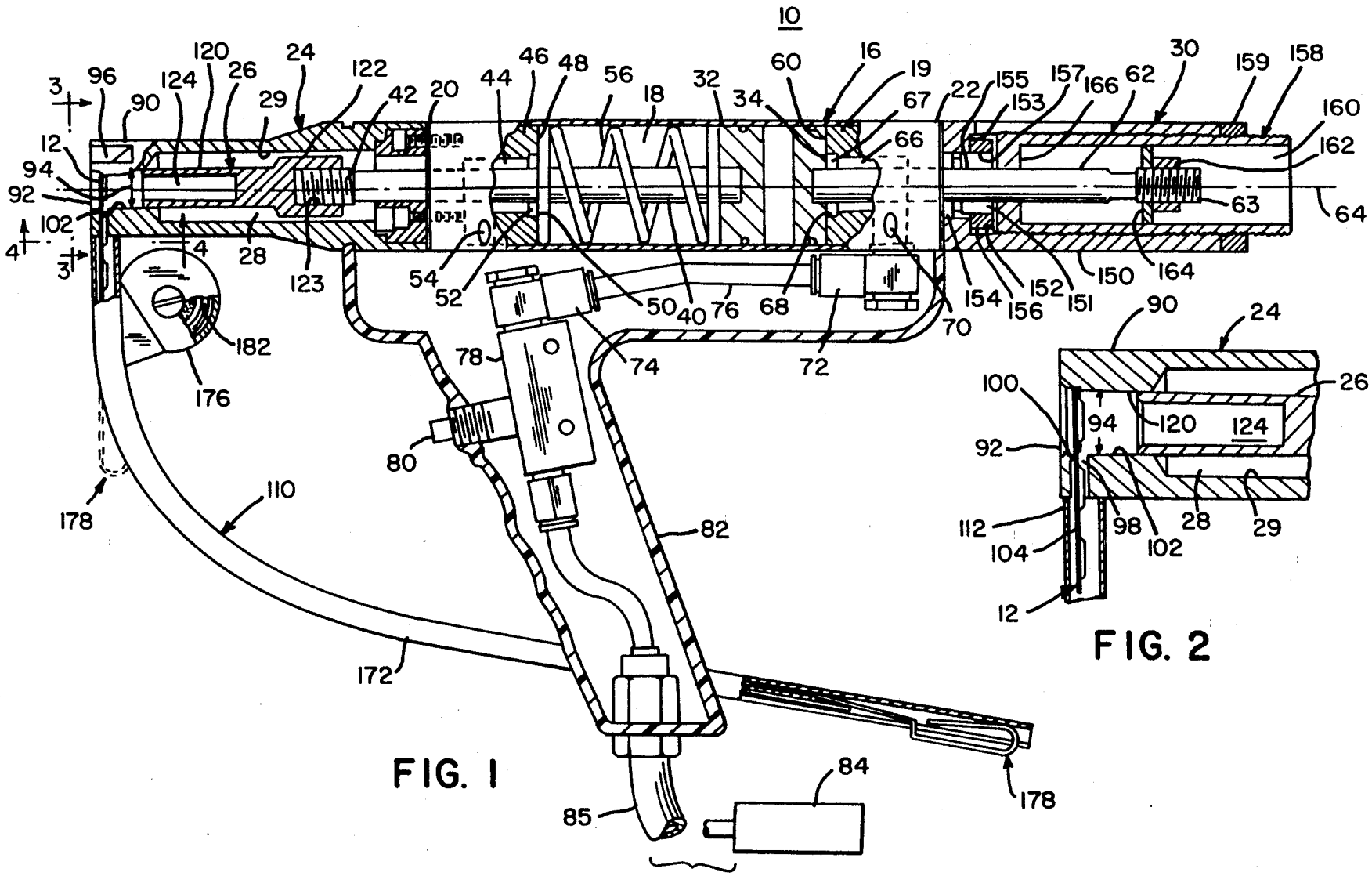
FIG. 1 is an elevational view in cross section, of the invention.
FIG. 2 is an enlarged sectional side elevational view of the discharge end of the applicator ram casing in FIG. 1.

A fluid-driven gun or tool assembly 10 for applying spring-grip fasteners 12 is illustrated in FIG. 1, wherein the fasteners 12 may be manually or mechanically applied and driven onto shafts, rods or axles 14 so as to secure the shaft to a panel, chassis, wheel or other apparatus. As an example, spring-grips 12 are utilized in the white-goods appliance industry so as to secure panels upon various appliances such as, for example, washers and dryers.

In FIG. 1, gun 10 comprises a housing 16 with cylinder 18 for a piston 32, first end 20 and second or back end 22, which piston 32 drives a fastener-applicator ram 26. More specifically, piston 32 at a reference position in FIG. 1 is slidably positioned against rear end cap 19 at back end 22 of housing 16. Applicator ram 26 in casing 24 is connected to piston 32, which is slidable so as to drive spring grip 12 onto shaft or rod 14. A first or forward rod 40 with threaded end 42 extends parallel to tool longitudinal axis 64 from piston 32, through cylinder 18 and into chamber 2 of casing 24. In the preferred embodiment, front end cap 46 in cylinder 18 at housing front end 20 has a through passage 44 having an axis disposed parallel to axis 64, which end cap 46 has an annular undercut or recess 50 at its piston-facing surface 48 with bearing or ring 52 mounted therein so as to guide and orient forward-extending shaft 40. Exhaust port 54 within housing 16 at front end 20 communicates with passage 44 and cylinder 18 for exhaustion of entrapped air during the forward travel of piston 32, which relieves any back-pressure acting against piston 32 during its forward progress within cylinder 18. Spring 56 disposed within cylinder 18 between front end cap 46 and piston 32 biases piston 32 to its reference position, which is thus the only force, beside friction, acting against an applied driving force upon piston 32. Second piston rod 62 extends along longitudinal axis 64 from piston 32 in an opposite direction with respect to rod 40 through longitudinal passage 66 defined within rear end cap 19, and into stroke-adjusting device 30. End cap 19 has second guide bushing 67 inserted within recess 68 defined within its piston-facing face 60 so as to maintain and guide rod 62.

Compressed air port 70 at housing rear face 22, communicates with end cap passage 66 and rear face 34 of piston 32. In FIG. 1, valve control 78 has a switch or trigger 80 extending through molded handle 82, which handle 82 is coupled to casing 24 and rear end cap 19. Port 70 is coupled through means of connectors 72 and 74, and conduit 76 to valve control 78, which is coupled a source of pressurized fluid 84 by means of conduit 85. Trigger 80 is operable so as to open communication between fluid source 84 and rear port 70 and drive piston 32, forward-extending rod 40 and applicator ram 26.

Casing 24 is secured to housing front or first end 20 of housing 16 with applicator ram 26 slidably positioned within its chamber 28. Casing 24 provides a housing or enclosure for applicator ram 26, which drives spring-grips 12 onto shafts 14, and has a forward or barrel end 90 with opening or bore 92 for the discharge of spring grip fasteners 12. Generally cylindrical chamber 28 has an inner sidewall 29 with a first diameter, which extends along longitudinal axis 64, as illustrated in FIG. 1, and tapers to second and narrow diameter portion 94 at opening or bore 92. Feed slot 98 in FIGS. 1 and 2 is defined within the lower portion of barrel end 90 for the insertion and retention of fasteners 12 within bore 92.

Figure 3:
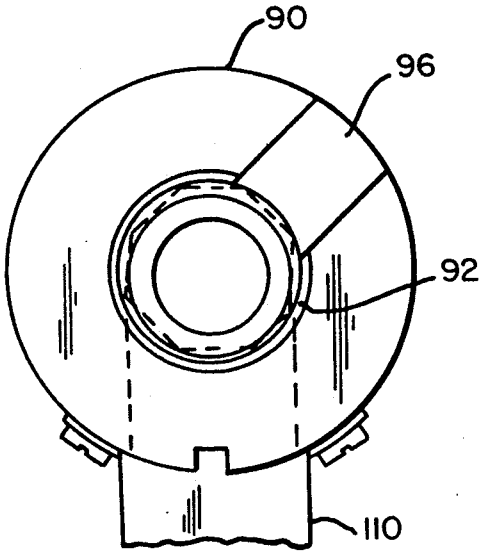
FIG. 3 is an enlarged end elevation view of the tool discharge end in FIG. 1 taken along the line 3—3 in FIG. 1.

In FIG. 2, casing 24 at the intersection of slot 98 and bore 92 has an angular tab 100 at inner bore surface 102 for contacting the back side 104 of fasteners 12 along a bridging element coupling adjoining fasteners 12, which edge contact of tab 100 provides a fulcrum for positive disengagement and severing of the lead fastener 12 from the remaining fasteners 12 attached to the continuous clip fed through magazine 110. As shown in FIGS. 1 and 3, window 96 within barrel end 90 provides a visual view or confirmation of the alignment of fastener 12 within bore 92 and upon the end of shaft or rod 14 prior to the mounting of the fastener 12 upon shaft or rod 14.

Applicator ram 26 within chamber 28 has head or barrel end 120 extending from its base end 122 with threaded blindhole bore 123 mating with threaded rod end 42. Barrel end 120 is slidable within bore 92 and has second blindhole bore or passage 124 extending along longitudinal axis 64, which passage 124 is matable with shaft 14. The diameter of blindhole bore 124 is compatible with axle or shaft 14, and allows fastener mounting upon shaft 14 up to the depth of bore 124.

Stroke-adjusting device 30 for adjustment of the displacement and stroke length of ram 26 and piston 32 is affixed to back end 22 of housing 16. Collar 150 has a bore with a first diameter and threaded internal sidewall 152, which sidewall is parallel to axis 64. Smaller diameter passage 154 of collar 150 is in proximity to back end 22 of housing 16 and mates with guide bushing 151 protruding from back end 22 of housing 16 along axis 64. Guide bushing 151 with threaded male end 157 has central aperture 155 along axis 64 so as to encase second rod 62. Nut 156 is matable with threaded male end 157 and contacts shoulder 153 at the intersection of passage 154 and bore 152 so as to secure collar 150 to housing 16.

Externally threaded sleeve 158 with internal bore 160 is threaded within cylinder bore 152 so as to abut its endwall 166 with nut 156 at a reference position. Second rod 62 extends from piston 32 through end cap passage 66 and guide bushing 151, and has threaded end 63 with mounted washer 164 and securing nut 162 slidably positioned within chamber or bore 160. Engagement of washer 164 with end wall 166 within sleeve 158 limits the travel of rod 62, piston 32 and ram 26. Threaded sleeve 158 is adjustable within bore 152 so as to vary the location of end wall 166 along axis 64, adjust the wall engagement position of washer 164 and vary the stroke of piston 32 and ram 26.

Figure 4:
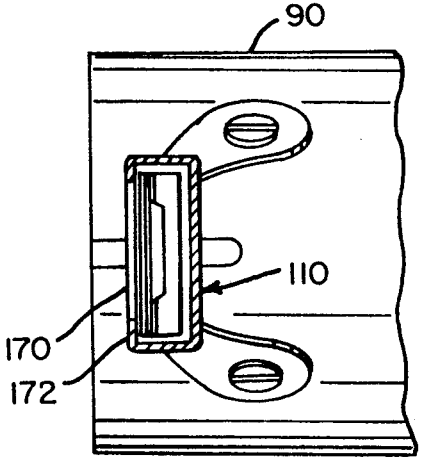
FIG. 4 is an enlarged cross-sectional view of the tool discharge end taken along the line 4—4 in FIG. 1.
Figure 7:
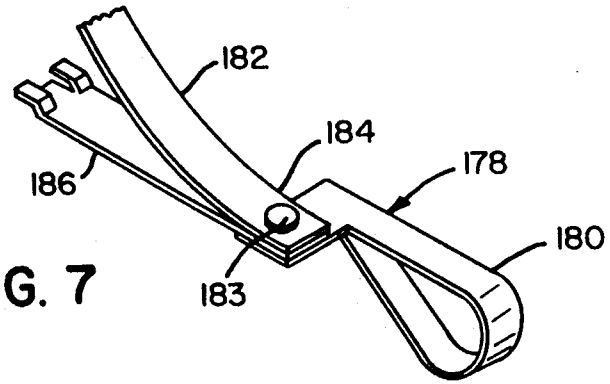

Fastener magazine or chute 110, which is shown as a U-shaped tube with opening 170 along lower surface 172 in FIGS. 1 and 4, is affixed to barrel end 90 and aligned with feed slot 98 at chute first end 112. Chute 110 is arcuately formed and extends past handle 82 from barrel end 90. Coil spring attachment 176 is mounted upon chute 110 in proximity to barrel end 90 with coil spring 182 and magazine spring handle 178, which handle is shown in dotted section at a reference position and in an operating position at the cross-sectional cutaway of FIG. 1. Handle 178 in FIG. 7 has projecting finger loop 180 attached to coil spring 182 by means of a rivet 183 at spring end 184. Forwardly-projecting clip 186 is also attached to spring end 184 and loop 180 by means of a rivet 183, which clip 186 contacts and grasps the strip of fasteners 12 within magazine 110. Fasteners 12 are positioned within chute 110 and are constantly biased by means of spring 182 for continuous loading and automatic positioning of fasteners 12 within into barrel end 90 through means of feed slot 98 for mounting upon shaft or axle 14 by means of actuator ram 26.

Gun 10 is operable by means of actuation of trigger 80 which opens communication of the pressurized fluid from pressure source 84 through means of controller 78 for introduction into cylinder 18. Piston 32 and ram 26 coupled to piston 32 are slidably driven by means of the fluid introduced at port 70 along axis 64 within cylinder 18 and chamber 28, respectively, so as to contact fastener 12 within barrel 90 and drivingly mount it upon rod or axle 14. Fluid-driven piston 32 is slidable within cylinder 18 against the biasing force of spring 56, and any fluid trapped within cylinder 18 ahead of piston 32 is forced out through means of discharge port 54 within cap 46, thus avoiding any extraneous biasing forces from the compressed fluid within cylinder 18. Avoidance of any added and variable biasing forces acting upon piston 32 other than that of spring 56 affords greater control of gun 10 and, more specifically, fastener placement upon shaft 14.

Figure 5:
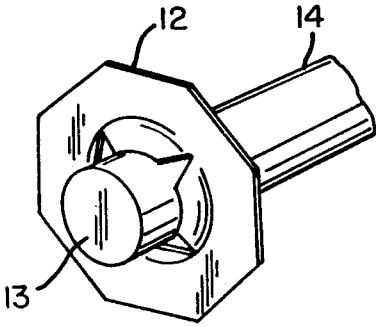
FIG. 5 is a perspective view of an exemplary spring-grip fastener mounted upon a shaft end.
Figure 6:
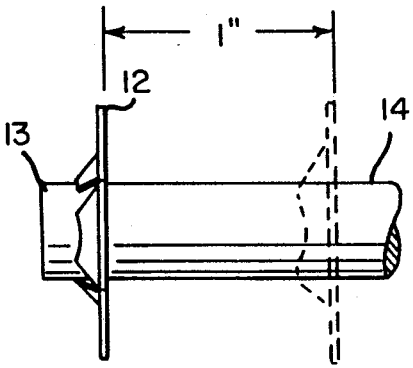
FIG. 6 illustrates the spring-grip of FIG. 5 displaced upon the shaft in FIG. 5; and, FIG. 7 is an enlarged perspective view of the grip for biasing the fasteners within the tool magazine.

Shaft 14 is positionable within bore diameter 94 so as to contact spring grip 12 and position shaft end 13 within the fastener bore, thus bore 94 is operable as a pilot for positioning shaft 14. Blindhole bore 124 within ram 26, is matable with shaft 14, which may be any depth desired by the user or operator. Thus, fastener 12 can be mounted upon shaft 14 at a desired displacement from rod end 13, such as, for example, one inch from its initial mounting upon shaft 14 as illustrated in FIGS. 5 and 6. In addition, the driving force or pressure of the fluid is adjustable at pressure source 84 so as to vary the driving force acting upon piston 32, which may be dependent upon operating variables or parameters, such as, for example, the spring or tensile strength of the fastener grip material and the load tolerance of the gun, barrel or shaft.

Piston stroke or travel, as noted above, is adjustable by means of stroke-adjusting device 30. More specifically, sleeve 158 is adjustable to a desired position from guide bushing 151 and secured in position by means of locknut 159 so as to locate end wall 166 for contacting end cap washer 164 and lock nut 162 and thereby limiting the travel of rod 62, piston 32, and ram 26 along longitudinal axis 64. This limitation upon the travel of end cap washer 164 effectively limits the travel of piston 32 and consequently the travel of applicator ram 26, which limits the depth of penetration of shaft 14 into blindhole bore 124 within ram 26. Thus, the fixed length or mounting distance upon shaft 14 of spring grip 12 can be fixed by means of the adjustment of the stroke-adjusting device 30.

While only specific embodiments of the invention have been described or shown, it is apparent that various alterations and modifications can be made therein. It is, therefore, the intention in the appended claims to cover all such modifications and alterations as may fall within the scope and spirit of the invention.

What is claimed is:

1. A fluid-driven tool for applying fasteners onto a shaft, said tool comprising:

a housing having a front end, a back end, and defining an enclosure;

means affixed to said housing front end for holding a fastener at an application position;

means for serially supplying a plurality of fasteners such that a lead fastener is held at said application position by said holding means;

means for applying said lead fastener, held at said application position by said holding means, upon said shaft;

means movably positioned within said enclosure and coupled to said applying means for driving said applying means in a fastener-applying direction;

a source of fluid pressure;

means for selectively communicating said source of fluid pressure to said enclosure so as to move said driving means and said applying means so as to contact and drive said lead fastener onto said shaft; and means adjustably mounted upon said housing for engaging said driving means as said driving means is moved in said fastener-applying direction so as to adjustably limit the stroke of said driving means and said fastener applying means so as to limit the distance said lead fastener is moved relative to said shaft as said lead fastener is being applied to said shaft.

2. A fluid-driven tool for applying fasteners as claimed in claim wherein said enclosure is a cylinder with a longitudinal axis.

3. A fluid-driven tool for applying a fastener onto a shaft as claimed in claim 2, further comprising means for biasing positioned in said cylinder to bias said driving means to a reference position at said housing back end.

4. A fluid-driven tool for applying a fastener as claimed in claim 3, wherein said means for applying said fastener has a casing with a first end, a second end, and a generally cylindrical through-bore, and an opening at each of said first and second ends;

an applicator ram coupled to said driving means having a ram longitudinal axis, which ram is mounted and slidable in said through-bore;

said ram having a sheath with a blindhole passage to receive said shaft and movable through one of said first and second end openings;

said holding means being positioned in said one end opening;

the other one of said first and second ends of said casing being connected to said housing front end;

said driving means having a connecting rod extending through said second opening and connected to said ram, said driving means operable to slidably move said ram to engage said fastener and drive it onto said shaft.

5. A fluid-driven tool for applying a fastener as claimed in claim 1, wherein said a stroke-adjusting device means is mounted at said back end of said housing.

6. A fluid-driven tool for applying a fastener as claimed in claim 4, wherein said driving means comprises a piston slidably mounted in said housing enclosure;

said piston having a first rod extending through said enclosure and said front end into said casing;

said applicator ram secured to said first rod;

said piston slidable in said enclosure to move said ram along said longitudinal axis to engage and mount said fastener on said shaft.

7. A fluid-driven tool for applying pressed-on fasteners as claimed in claim 6, said piston further comprising a second rod extending through said housing back end into said stroke-adjusting means;

said second rod having a rod tip in said stroke-adjusting means;

a washer mounted on said rod tip, means for securing said washer mounted on said rod tip in said stroke-adjusting means to secure said washer and to act as an abutment to retain said second rod in said stroke-adjusting means.

8. A fluid-driven tool as claimed in claim 7 wherein said stroke-adjusting means comprises a collar with a threaded internal bore, which collar has a first end affixed to said housing back end;

a guide bushing positioned on said second rod in said bore in proximity to said housing;

an externally threaded sleeve matable with said threaded bore, which sleeve has an end wall having a port, said second rod extending through said port into said sleeve and, said washer operable to contact said end wall to limit said piston and ram stroke distance.

9. A fluid-driven tool as claimed in claim 8 wherein said sleeve is adjustable to vary end wall separation from said housing back end to adjust said stroke of said piston and ram.

10. A fluid-driven tool as claimed in claim 9 further comprising a securing annulus with internal threads and mountable on said sleeve to abut said collar and secure said sleeve at a desired end wall separation.

11. A fluid-driven tool for applying fasteners as claimed in claim 3 wherein said means for biasing is a coil spring mounted in said cylinder between said housing front end and said piston to bias and return said piston to said reference position after mounting of a fastener on a shaft.

12. A fluid-driven tool for applying fasteners as claimed in claim 11, said housing having a breather port in proximity to said front end, said port operable to vent said cylinder during piston travel and provide better control of said piston and ram.

13. A fluid-driven tool for applying fasteners as claimed in claim 1 wherein said source of fluid pressure is compressed air.

14. A fluid-driven tool for applying fasteners as claimed in claim 1 further comprising a molded handle, said tool mounted on said handle to enhance operator control of said tool.

15. A fluid-driven tool for applying fasteners as claimed in claim 6 further comprising a fastener magazine having a track and second means for biasing;

a plurality of fasteners in said track;

said applicator casing having a first diameter at said one end and a fastener-feed aperture to introduce said fasteners to said through-bore and said holding means;

said magazine coupled to said casing at said fastener-feed aperture with said second biasing means operable to bias said fasteners in said track to provide a continuous supply of fasteners to said casing through-bore for positioning in said holding means and mounting on a shaft.

16. A fluid-driven tool for applying fasteners as claimed in claim 15 wherein said casing defines a window open to said through-bore for viewing said fastener in said holding means.

17. A fluid-driven tool for applying pressed-on fasteners as claimed in claim 15 wherein said through-bore at said one end has a first diameter and a second diameter with a shoulder therebetween;

said fastener feed aperture in proximity to said one end at said through-bore having an edge at an acute angle, which edge contacts said fastener;

said fastener positionable in said through-bore against said contacting edge for alignment in said bore and to assist in separation of said applied fastener from said plurality of fasteners.

18. A tool as set forth in claim 1, wherein said means adjustably mounted upon said housing so as to adjustably limit the stroke of said driving means comprises:

an internally threaded collar fixedly mounted upon said housing; and an externally threaded sleeve, having an end wall for engaging said driving means, threadedly engaged with said internally threaded collar.

19. A fluid driven tool for applying fasteners onto a shaft, comprising:

a housing;

axial bore means defined within said housing for holding a fastener at an application position and for receiving an end of said shaft upon which said fastener is to be mounted;

means for serially supplying a plurality of fasteners, disposed within a strip of fasteners wherein successive fasteners are connected together by means of a bridging portion, such that a lead fastener is disposed at said application position within said axial bore means;

means for engaging a rear surface, as considered with respect to a fastener-applying direction, of said lead fastener disposed at said application position within said axial bore means and for enveloping said end of said shaft upon which said lead fastener is to be mounted so as to mount said lead fastener at a predetermined axial position upon said shaft which is located a predetermined distance from an end surface portion of said shaft which si disposed transverse to a longitudinal axis of said shaft;

means movably positioned within said housing and connected to said engaging and eveloping means for driving said engaging and enveloping means in said fastener-applying direction;

a source of fluid pressure;

means for selectively communicating said source of fluid pressure to said housing so as to move said driving means and said engaging and enveloping means so as to engage said lead fastener and envelop said end of said shaft so as to mount said lead fastener upon said shaft; and tab means defined within said housing at said application position for engaging only a front surface, as considered with respect to said fastener-applying direction, of a bridging portion of said fastener strip, defined between said lead fastener disposed at said application position and a successive fastener within said fastener strip, so as to cooperate with said engaging and enveloping means and therefore facilitate separation of said lead fastener from said successive fasteners disposed within said fastener strip as said engaging and enveloping means is moved in said fastener-applying direction during application of said lead fastener upon said shaft.

20. A tool as set forth in claim 19, wherein:

said housing comprises a fastener-feed entry slot defined within a peripheral wall portion thereof; and said tab means is disposed at the intersection of said fastener-feed entry slot and said axial bore means.

21. A tool as set forth in claim 19, wherein said engaging and enveloping means comprises:

a ram having a blind bore defined within an end portion thereof wherein an outer peripheral portion of said ram, within which said blind bore is defined, is slidably disposed within said axial bore means of said housing while said blind bore has an internal peripheral portion which accommodates said end of said shaft upon which said lead fastener is to be mounted.

* * * * *